US007442083B1

(12) United States Patent
Ju

(10) Patent No.: US 7,442,083 B1
(45) Date of Patent: Oct. 28, 2008

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/780,747

(22) Filed: Jul. 20, 2007

(51) Int. Cl.
*H01R 13/648* (2006.01)

(52) U.S. Cl. ..... 439/608

(58) Field of Classification Search ..... 439/747, 439/76.2, 449, 470, 590, 746, 748, 607–9, 439/931
See application file for complete search history.

(56) References Cited

U.S. PATENT DOCUMENTS 4,379,611 A * 4/1983 Foege et al. ..... 439/747
5,065,284 A * 11/1991 Hernandez ..... 361/794
RE35,064 E * 10/1995 Hermandez ..... 361/763
5,625,225 A * 4/1997 Huang et al. ..... 257/700
5,683,257 A * 11/1997 Kobayashi et al. ..... 439/76.2
6,039,590 A * 3/2000 Kunishi ..... 439/247
2001/0051467 A1 * 12/2001 Kubo ..... 439/752

* cited by examiner

*Primary Examiner*—Jean F Duverne
(74) *Attorney, Agent, or Firm*—Rosenberg, Klein & Lee

(57) ABSTRACT

An electrical connector for connecting an electrical device and a circuit board of the present invention comprises an insulating body having a plurality of terminal receiving holes and a plurality of conductive terminals. A plurality of metal-film layers are respectively sputtered on the inside walls of the terminal receiving holes. A plurality of metal wires which respectively make that metal-film layers of the terminal receive holes connect with each other are mounted at least one surface of the insulating body. A conducting portion is mounted on the bottom surface of the insulating body. The metal wire connects with the circuit board by the conducting portion. The metal wire is formed as a sputtered layer. The electrical connector can shield electromagnetic disturbances and conduct static electricity on the metal-film layer to leave out in order to accomplish that the electrical connector connects with the electrical device effectively.

11 Claims, 2 Drawing Sheets

ELECTRICAL CONNECTOR

BACKGROUND OF THE INVENTION

1. Field of the Invention

The present invention is related to an electrical connector; particularly the electrical connector can prevent electromagnetic disturbances.

2. Description of Related Art

Because the electrical technology has progressed so much in recent times constantly, the electromagnetic disturbance between a electrical connector and external electrical devices, and between two conductive terminals have become more and more serious. The above situation makes that the electrical connector can't electrically connect with external electrical devices effectively. Performance of the electrical connector is affected. The present technology for preventing electromagnetic disturbances almost is electro-plating or chem-plating. Both plating technologies cause serious environmental pollution. Overcast rete is not compact. It makes that the performance for preventing electromagnetic disturbance is not good. Simultaneously static electricity on surface of the overcast rete also disturbs electrical terminals of the electrical connector. Performance of the electrical terminal is affected.

Hence, the inventors of the present invention believe that these shortcomings above are able to be improved upon and suggest the present invention which is of a reasonable design and is an effective improvement based on deep research and theory.

SUMMARY OF THE INVENTION

The object of the present invention is to provide an electrical connector so that the electrical connector can electrically connect with electrical device efficiently.

For achieving the object described above, the present invention provides an electrical connector. The electrical connector for connecting an electrical device and a circuit board comprises an insulating body having a plurality of terminal receiving holes and conductive terminals. The conductive terminals are respectively disposed in the terminal receiving holes. A plurality of metal-film layer are respectively sputtered on the inside walls of the terminal receiving holes.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to limit the present invention to the precise form disclosed.

Figure 1:
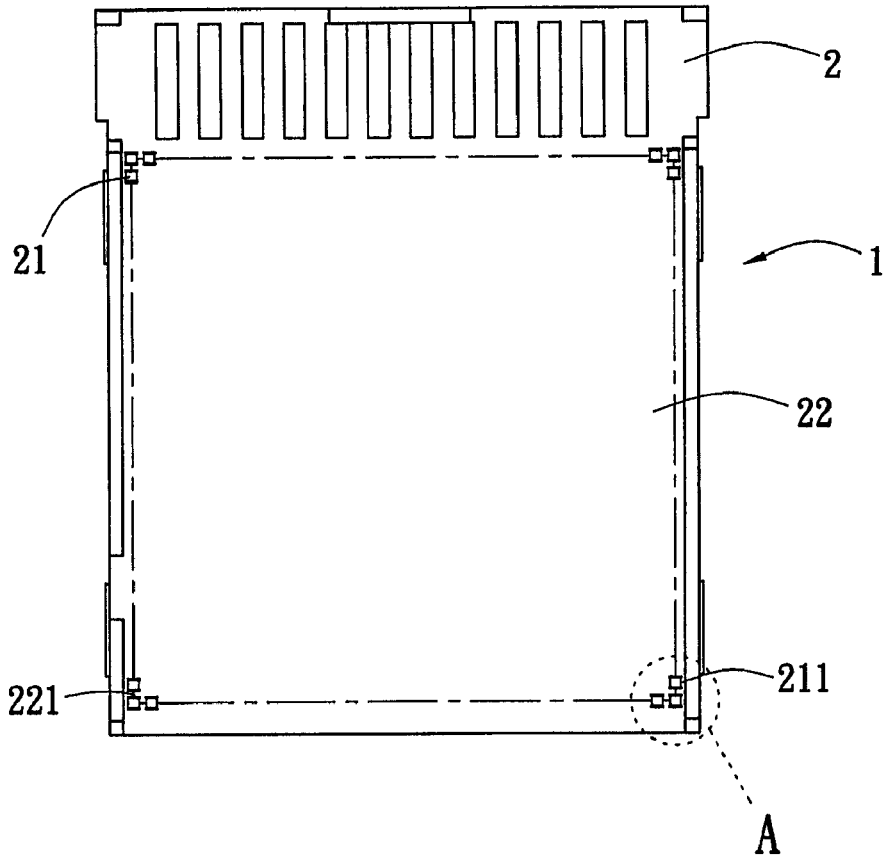
FIG. 1 is a bottom view according to the electrical connector of the present invention.
Figure 2:
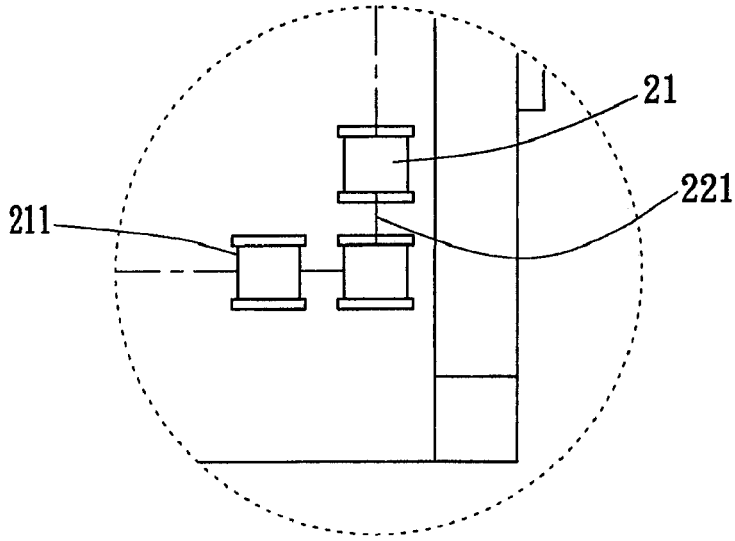
FIG. 2 is an enlarged drawing according to 'A' portion of FIG. 1.
Figure 3:
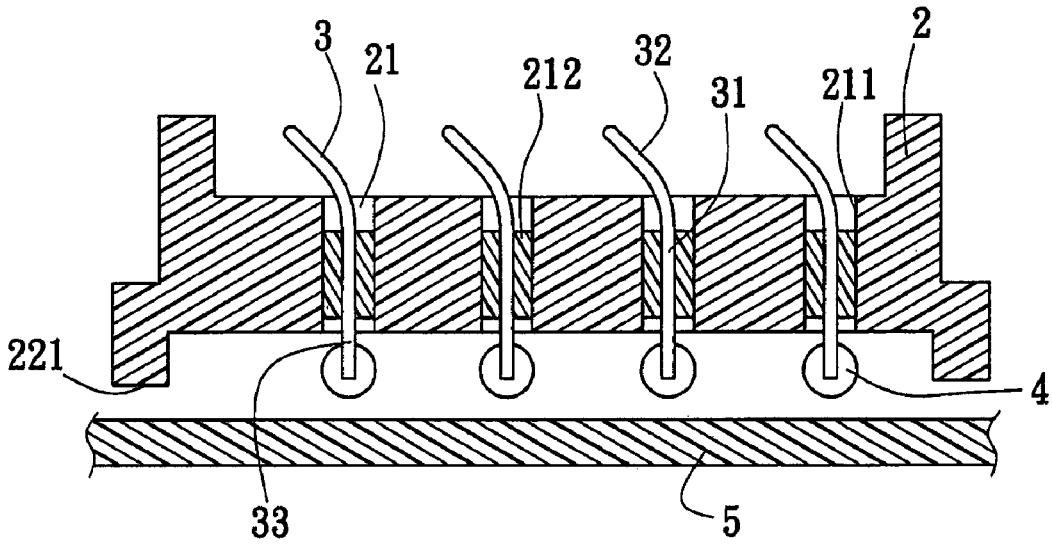
FIG. 3 is a cross-sectional view of FIG. 1.

Please refer to FIGS. 1 to 3, in which the present invention of an electrical connector is shown. The electrical connector can be used to make an electrical device electrically connects with a circuit board 5. The electrical connector 1 comprises an insulating body 2, a plurality of conductive terminals 3, and a plurality of solders which are respectively stuck on the end of the conductive terminals 3. In the first embodiment, the solders are used as tin balls 4.

A plurality of terminal receiving holes 21 are mounted on the insulating body 2. Conductive terminals 3 are respectively disposed in the terminal receiving holes 21. Beside, A plurality of insulating block 212 which fix the conductive terminals 3 are respectively disposed in the terminal receiving holes 21, and a plurality of metal-film layers 211 which can shield electromagnetic disturbances are respectively sputtered on the inside wall of the terminal receiving holes 21.

The details of the sputtering technology are described below:

(1) Fill up adequate argon into a sputtering mechanism, and pressure in inside of sputtering mechanism is only $10^{-7}$ torr.

(2) Use high DC power to ionize the argon. The argon is ionized to become ionic argon. Accelerate ionic argon.

(3) Accelerated ionic argon impact a metal target, and the metal target is impacted to sputter ionic metal.

(4) The ionic metals sputter the insulating body 2 to form a metal-film layer 211.

The characteristics of the metal-film layer 211 are very continuous and compact, and the thickness of the metal-film layer 211 can be controlled easily. The metal-film layer 211 has high shielding characteristic. The metal-film layer 211 is even. The intension and tolerance of the inside wall of the terminal receiving holes 21 aren't affected by the metal-film layer 211, and the adhesive force of the metal-film layer 211 is high.

Because static electricity is existed on the surface of each metal-film layer 211, a plurality of metal wires 221 which respectively make that metal-film layers 211 of the terminal receive holes 21 connect with each other are mounted at least one surface of the insulating body 2. The insulating body 2 has a bottom surface 22. In the first embodiment, the metal wires 221 are mounted on the bottom surface 22 of the insulating body 2. Each metal wire 221 is formed as a metal layer which is capped on the bottom surface 22. The metal wire 221 also can be formed as a sputtered layer. The forming theories of the above forms of the metal wire 221 are the same. The metal wires 221 connect with the circuit board 5 directly to arrive the function of eliminating static electricity.

Each conductive terminal 3 is integrated. Each conductive terminal 3 is disposed in the terminal receiving hole 21. Each conductive terminal 3 doesn't contacts with the inside wall of each terminal receiving hole 21. The conductive terminal 3 comprises a fixing portion 31 which is fixed in the inside of the insulating block 212, a contacting portion 32 which is extended upwardly from the fixing portion 31, and a connecting portion 33 which is extended downwardly from the fixing portion 31. The connecting portion 33 can electrically connect with the circuit board 5.

Figure 4:
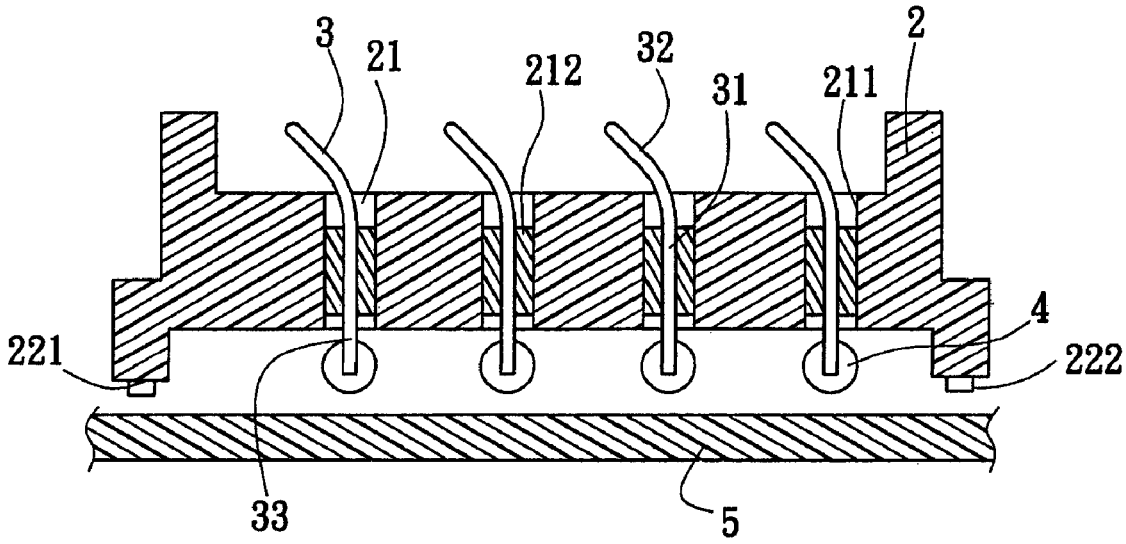
FIG. 4 is a cross-sectional view according to the second embodiment of the electrical connector of the present invention.

Please refer to FIG. 4, in which the second embodiment according to the electrical connector is shown. The different architecture of the second embodiment according to the electrical connector is described below: A plurality of conducting portions 222 are mounted on the bottom surface 22 of the insulating body 2. The metal wires 221 connect with the circuit board 5 by the conducting portions 222.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electrical connector for connecting an electrical device and a circuit board, comprising:

an insulating body having a plurality of terminal receiving holes, each terminal receiving hole having a metal-film layer sputtered on an internal surface thereof;

a plurality of conductive terminals respectively extending through the terminal receiving holes; and a plurality of insulating blocks respectively disposed in the terminal receiving holes, each insulating block affixing a corresponding one of the conductive terminals and electrically insulating the corresponding conductive terminal from the metal-film layer.

2. The electrical connector as claimed in claim 1, wherein at least one surface of the insulating body has a metal wire which connects with the metal-film layer connecting with the circuit board electrically.

3. The electrical connector as claimed in claim 2, wherein the metal wire is formed as a sputtered layer.

4. The electrical connector as claimed in claim 1, wherein at least one surface of the insulating body has a metal wire which connects with the metal-film layer and the circuit board by a conducting portion which is mounted on the surface of the insulating body.

5. The electrical connector as claimed in claim 4, wherein the metal wire is formed as a sputtered layer.

6. The electrical connector as claimed in claim 1, wherein at least one surface of the insulating body caps a metal layer which connects with each metal-film layer and the circuit board.

7. The electrical connector as claimed in claim 6, wherein the metal layer is formed as a sputtered layer.

8. The electrical connector as claimed in claim 1, wherein at least one surface of the insulating body caps a metal layer which connects with each metal-film layer and the circuit board by a conducting portion which is mounted on the surface of the insulating body.

9. The electrical connector as claimed in claim 8, wherein the metal layer is formed as a sputtered layer.

10. The electrical connector as claimed in claim 1, wherein the insulating block is an elastic body.

11. The electrical connector as claimed in claim 1, wherein each conductive terminal includes a fixing portion affixed within a respective terminal receiving hole by a corresponding insulating block; a contacting portion extending upwardly from the fixing portion to electrically connect with the circuit board; and a connecting portion extending downwardly from the fixing portion.

* * * * *